US007207719B2

(12) United States Patent
Marbler et al.

(10) Patent No.: US 7,207,719 B2
(45) **Date of Patent: *Apr. 24, 2007**

(54) PACKING MADE FROM A FILM-LIKE LAMINATE AND PROCESS FOR PRODUCTION OF THIS PACKING

(75) Inventors: Claude A. Marbler, Phalsbourg (FR); Sabine Cerf, Sarrebourg (FR)

(73) Assignee: Alcan Technology & Management Ltd., Neuhausen Am Rheinfall (CH)

( * ) Notice: Subject to any disclaimer, the term of this patent is extended or adjusted under 35 U.S.C. 154(b) by 299 days.

This patent is subject to a terminal disclaimer.

(21) Appl. No.: 10/727,649

(22) Filed: Dec. 5, 2003

(65) Prior Publication Data

US 2004/0086207 A1 May 6, 2004

Related U.S. Application Data

(62) Division of application No. 09/868,899, filed as application No. PCT/CH00/00002 on Jan. 4, 2000, now Pat. No. 6,726,363.

(30) Foreign Application Priority Data

Jan. 21, 1999 (CH) ..... 111/99

(51) Int. Cl.
*B65D 33/00* (2006.01)
*B65D 30/08* (2006.01)

(52) U.S. Cl. ..... 383/200; 383/116

(58) Field of Classification Search ..... 383/200, 383/116, 201, 207
See application file for complete search history.

(56) References Cited

U.S. PATENT DOCUMENTS

| | | | | |
|---|---|---|---|---|
| 3,388,789 | A | 6/1968 | Simandl et al. | |
| 3,608,815 | A | 9/1971 | Bunch | |
| 4,778,058 | A | 10/1988 | Yamazaki | |
| 4,903,841 | A | 2/1990 | Ohsima et al. | |
| 5,613,779 | A | 3/1997 | Niwa | |
| 6,102,571 | A | 8/2000 | Moteki et al. | |
| 6,726,363 | B1 * | 4/2004 | Marbler et al. | 383/200 |
| 7,111,986 | B2 * | 9/2006 | Marbler et al. | 383/200 |

FOREIGN PATENT DOCUMENTS

| | | |
|---|---|---|
| EP | 0450247 | 10/1991 |
| EP | 0521618 | 1/1993 |
| EP | 0540184 A | 5/1993 |
| EP | 0 596 747 A1 * | 5/1994 |
| EP | 0596747 A1 | 5/1994 |
| FR | 2717449 | 9/1995 |
| WO | WO 9106488 | 5/1991 |

* cited by examiner

*Primary Examiner*—Jes F. Pascua
(74) *Attorney, Agent, or Firm*—Fisher, Christen & Sabol

(57) ABSTRACT

Packaging for receiving liquid, pasty, powdery, granular or solid material having tear-open means and sealed edges and made of a foil-shaped composite material. The foil-shaped composite material has multiple layers. At least one layer of the composite material does not have weakened areas. At least one layer of the composite material has weakened areas located in the packaging at least partly in the area of the filling space. The weakened areas are preferably a plurality of parallel individual cuts.

7 Claims, 3 Drawing Sheets

PACKING MADE FROM A FILM-LIKE LAMINATE AND PROCESS FOR PRODUCTION OF THIS PACKING

This is a division of U.S. Ser. No. 09/868,899, filed on Jul. 9, 2001, now U.S. Pat. No. 6,726,363, issued on Apr. 27, 2004, that is a 371 of International Patent Application PCT/CH00/00002, filed on Jan. 4, 2000, that has priority benefit of Swiss Patent Application 111/99, filed on Jan. 21, 1999

BACKGROUND OF THE INVENTION (1) Field of the Invention

The present invention concerns a packing with a tear aid and sealed edges, made from a film-like laminate material, a process for production of the packing, means for production of the packing and use of the packing.

(2) Background of the Invention

Sealed edge bags are known, for example, which are used for packing powdery or solid fillings. Typical fillings can come from the area of foodstuffs and luxuries such as powdered instant coffee or chocolate bars, dairy produce such as yoghurt and the like. The packing must protect the filling against mechanical, chemical and physical influences. Therefore, in many cases such packings are made from multilayer materials where individual material layers or a material layer combination can have a specific protective function. The packing material must for example be tear-resistant. This requires very extendible or stretchable materials of high structural strength. Opening packings made from such materials is difficult and cannot be achieved without the aid of scissors or a knife. To facilitate opening without a tool, therefore, tear aids are regularly fitted to the packing. A tear aid can for example be a notch on the outer edge of a sealing seam. The material of the packing equipped in this way can be torn open very easily, on further tearing through the bag wall the direction of tear can no longer be controlled and the resulting opening is often incomplete or leads to the centre through a side wall. The tear aid must be applied in the packing machine. This reduces the operating speed of the packing machine. In many cases attempts are made to eliminate the disadvantages by placing a tear strip between two material layers, and by pulling of the tear strip the packing material is split. The resulting opening is clearly defined but the production of this tear aid is complex and leads to inflexible production processes.

BROAD DESCRIPTION OF THE INVENTION

The task of the present invention is to propose a packing which offers optimum protection to the filling but nonetheless is easy to open, can be produce in a simple manner and minimizes the use of machines while retaining maximum freedom with regard to packing design.

DETAILED DESCRIPTION OF THE INVENTION

According to the invention this is achieved by the film-like laminate material being multilayer and at least one material layer of the laminate has no weakened zones and at least one material layer of the laminate has weakened zones and the weakened zones on the packing lie at least partly in the area of the filling cavity.

Examples of packings according to the present inventions are sachets such as flat sachets, sealed edge sachets, cavity sachets, self-supporting cavity sachets or hose sachets or bags such as welded flat or folded bags. Similarly the packing can have at least one sealing seam on a side edge, e.g. a sealing seam such as a hot or cold sealing seam, weld seam or glue seam. Depending on the method of production, flat sachets can for example have three or four sealing seams on three or four side edges, a hose sachet can have an upper and a lower transverse seam or an upper and a lower and a back seam such as an overlapping or folded back seam.

The weakened zones on the packing according to the invention preferably lie in the area of the sealed edges and/or in areas in which by folding and/or sealing, the laminate material forms two or more layers. The weakened zones can for example extend from an outer border of a sealed edge, through this to over the filling cavity of a packing. One or more of the weakened zones can for example extend from an outer edge of a packing over the filling cavity of a packing. One or more of the weakened zones can for example also extend only over the cavity of a packing. Several weakened zones are advantageously located in a substantially straight line. Weakened zones are advantageously placed in the area of an edge closure or sealed edge closure of a packing. For example, the area, measured from an edge closure or sealed edge closure, can extend up to 50 mm, suitably up to 20 mm, over the filling cavity. The area can also extend at a distance of 2 to 20 mm parallel to an edge closure or sealed edge closure over the filling cavity in a width of for example 5 to 50 mm, suitably 5 to 20 mm.

The film-like laminate material, for example, two, three, four layer, etc. The individual material layers can be lacquer applications, metal films, metalized coatings or films of plastics, in particular thermoplastics, or laminates of metal films and plastic films. One or more material layers can be extruded and in particular melt-extruded layers or films of thermoplastics, where applicable laminated with metal or plastic films. At least one material layer can be a lacquer application such as a clear lacquer, a color lacquer, a hot melt coating, etc., At least one material layer can be a metalized coating, or a ceramic thin coating deposited from a vacuum. Between the individual coatings can be adhesives, extrusion adhesive, adhesion promotion agents and/or primers. To increase the mutual adhesion of the coatings, the surfaces of the films, coatings or material layers can for example be subjected to corona, flame, ozone or plasma treatment.

Material layers of thermoplastics can be transparent, translucent or opaque. For example the material layer, film or coating on the outside of the packing can be printed. In the case of a transparent or translucent outer material layer, film or coating, counter-printing or external printing and counter-printing can be applied.

For metal films for example, steel foils and preferably aluminium foils are used. The thickness of the foil can for example be 5 to 100 μm, preferably 8 to 30 μm.

Suitable plastic films are suitably made of thermoplastics such as polyesters, polyolefins such as polypropylenes or polyethylenes, polyamides, polyvinyl chloride, polycarbonate etc. or cellulose-containing materials such as cellophane. Plastic films can be monofilms or film laminates. The thickness of the plastic films can for example be 8 to 100 μm, preferably 12 to 30 μm and in particular 12 to 23 μm.

Extruded or melt-extruded layers can for example be made of polyolefins such as polypropylenes or polyethylenes. The thickness of the extrudates can for example be 8 to 100 μm, preferably 12 to 30 μm, and in particular 12 to 23 μm.

The side of the laminate material facing the inside of the packing can advantageously be sealed. Where applicable the side of the laminate material facing the outside can also be sealed.

Examples of multilayer laminates are laminates containing a first material layer and a second material layer. The first material layer can be a film such as a monofilm or laminate of thermoplastics such as polyesters, polyolefins such as polypropylenes or polyethylenes, polyamides, polyvinyl chloride, polycarbonate, etc., or cellulose-containing materials such as cellophane or papers. The film can be printed and/or counter-printed on the side of the finished packing facing the outside. The second material layer can for example be a metal foil or metal film with a sealing coating applied to the side of the finished packing facing the inside, or a sealable film. The second material layer can in another embodiment be a sealable film of thermoplastic or an extrusion layer of a thermoplastic which is preferably sealable. Where applicable, papers can be used, e.g., coated papers as a second material layer. Where applicable, as the second material layer, lacquer coatings or paint applications can be used. The lacquers can be clear, opaque or colorless or colored. Depending on the product to be packed, the laminate material can have barrier properties against the penetration of fluids, gases, vapors, water vapor, aromas or flavorings etc. To achieve barrier properties one can use metal foils, metalized coatings, e.g., of aluminum, ceramic thin coatings, e.g., from silicon oxides and/or aluminum oxide applied by sputtering or deposition under vacuum, or plastic films, e.g., materials from the range of styrene copolymers, ethyl vinyl alcohol polymers or polyvinylidene chloride. Examples of sealable materials for the films or extrudates are polyolefins such as polyethylene, polypropylene or co- and terpolymers of ethylene with acrylic acid. The sealability of the laminate can also be achieved by application of a sealing lacquer.

From said material layers the following laminate materials can for example be made, where the material layers can be connected together where applicable by adhesives, adhesion promotion agents and/or primers, or the second material layer can be applied to the first material layer by extrusion such as melt extrusion:

a) first material layer of $a_1$) where applicable printed,
   $a_2$) film of polyesters, polyolefins such as polypropylenes or polyethylenes, polyamides, polyvinyl chloride, polycarbonate etc.;
   $a_3$) where applicable counter-printing;
b) connected by means of an adhesion promotion agent, adhesive coating or extrusion coating with
c) second material layer of $c_1$) metal film,
   $c_2$) adhesion promotion agent, adhesive layer,
   $c_3$) sealing film or sealable extrusion coating or sealing lacquer;

or in a further embodiment a a) first material layer of $a_1$) where applicable printed,
   $a_2$) film of polyesters, polyolefins such as polypropylenes or polyethylenes, polyamides, polyvinyl chloride, polycarbonate etc.
   $a_3$) where applicable counter-printing;
b) connected by means of an adhesion promotion agent, adhesive coating or extrusion coating with
c) second material layer of sealing film or sealable extrusion layer.

Further embodiments are a) first material layer of $a_1$) where applicable with printing on
   $a_2$) paper,
b) connected by means of an adhesion promotion agent, adhesive coating or extrusion coating with
c) second material layer of a polyolefin coating and in particular a polypropylene coating e.g. in a thickness of up to 100 μm, preferably 50 to 80 μm;

or a) first material layer of $a_1$) where applicable with printing,
   $a_2$) film of polyesters such as polyethylene, polyethylene terephthalate,
   $a_3$) where applicable counter-printing
b) connected where applicable by means of an adhesion promotion agent, adhesive coating or extrusion coating with
c) a metal film or applied metallised coating, and
d) connected by means of an adhesion promotion agent, adhesive coating or extrusion coating with
e) second material layer of a film of polyolefins such as polyethylene;

or a) a first material layer of $a_1$) where applicable printed,
   $a_2$) film of polyesters, polyolefins such as polypropylenes or polyethylenes, polyamides, polyvinyl chloride, polycarbonate etc.
   $a_3$) where applicable counter-printing and
b) a second material layer of a lacquer coating or sealable extrusion coating.

In the latter case the counter-printing $a_3$) can simultaneously constitute the second material layer.

The laminate material has weakened zones in at least one material layer of the laminate material. Preferably the weakened zones are provided on the first material layer of the laminate material. It is also possible to provide the weakened zones on the second material layer or on the first and second layers of the laminate material. In the last case it is advantageous for the weakened zones of the first material layer and the second material layer of a laminate material not to be arranged above each other but offset from each other. Weakened zones can for example be material weaknesses such as thinner material, material removed or notches in the material, or cuts in the form of individual cuts or a sequence of cuts, in particular arranged in parallel, or in the form of perforations etc. Particularly preferred as weakened zones are cut sequences or a multiplicity of individual cuts arranged in parallel. The cut direction advantageously runs in the tear direction. For example, the space between the cuts is for example 0.1 to 1 mm, the length of the cuts 1 to 50 mm and the number of cuts per weakened zone can be 2 to 50. The weakened zones can be located only over the filling cavity of a packing, or over the filling cavity and extend to within a sealed edge or side seam. The material layer or layers with weakened zones on a packing advantageously constitute an external layer or layer facing the outside of the laminate material.

The present invention also concerns a process for application of the weakened zones to the laminate material. The laminate material is produced by provision of the first material layer, where applicable printing of the first material layer on one or both sides and simultaneous application of the weakened zones in the register. Suitable printing processes are for example book, offset, flexo, screen and rotogravure printing. The first material layer can be weakened in the area of the printing machine, before, between two color applications, or after the printing ink application. The weakened zones can be generated by the application of weaknesses or perforations. This can be achieved mechanically for example by blades such as oscillating blades, rotating blades fitted to a cylinder, punch blades or needles, etc. Other devices for application of the weakened zones are energy-rich radiation such as laser beams or electron beams. Such processes normally lead to micro perforations. The weaknesses are applied to the first material layer in the registers, i.e., in synchrony with the printing. This allows precise alignment of the weakening at the same time as precise alignment of the printing on the packing material. It is also possible to perform the weakening at the start or during the printing ink application or before any proposed lacquer or protective lacquer application. The weakening is then covered by the printing inks and/or lacquer or protective lacquer. Thus a barrier effect is achieved against the exchange of substances from moisture, gases, etc., for example, through the openings of a perforation or a cut. At the same time the weakened zones can be stabilized with regard to tear strength without making it difficult to achieve the desired tear-opening. Preferably, the printing and weakening processes are performed continuously on endless or rolled goods, the processing of films or leaves is however also possible.

According to the process steps described, the first material layer and the provided second material layer are joined and connected together preferably continuously. The first material layer and second material layer as endless goods can for example be connected together inseparably by lamination or adhesion of the two material layers by means of an extrusion laminator or adhesive. For example, lacquer lamination adhesives, adhesion promotion agents and/or primers can be used. Examples of adhesives are also waxes, watery glues, plastic dispersions and high pressure polyethylene layers.

The second material layer can be applied to the first material layer also by coating or by extrusion, where under pressure and heat a thermoplastic, for example high pressure polyethylene, is melted and pressed as a thin film onto the one surface of the first material layer. If the second material layer is a lacquer application, the lacquer can be applied as a second material layer in quantities of for example 0.5 to 50 $g/m^2$, preferably 1.0 to 25 $g/m^2$ e.g. by pouring, spraying, spreading, smooth roller application etc. onto a first material layer already containing weakened zones. The lacquers can be solvent-based and dried or hardened by vaporisation of the solvent or the lacquers can be hardened by energy-rich radiation. Suitable lacquers are for example acrylate- or methacrylate-based, or lacquers from the range containing polyester, epoxides, cellulose nitrate, polyvinyl chloride, polyvinyl butyral or mixtures thereof.

The laminate material produced in this way can be introduced into a packing machine for example in endless or roll form and used for packing goods. Due to the production process according to the invention, the printing and the weakened zones on the laminate lie in unchanging position to each other. High quality packing units are characterised in that the printing always corresponds to the pack size and is always positioned identically in relation to the filling. Thus with the use of the present laminate material the weakened zones corresponding to the printing always lie at the same point on every packing unit. Typical packing units are for example polygonal and in particular rectangular in top view. In cross section the packing units can be round or polygonal and in particular rectangular. The weakened zones are for example in the area of the side edges and in longitudinal packing units in the area of one of the two long ends. In relation to the cross section of the packing unit the weakened zones suitably lie on one or both side edges. Where a packing unit has points at which the packing material forms several material layers due to folding or gluing, preferably in this area there is a weakened zone on at least one material layer. For packing units with a back seam, there is at least one weakened zone in the area of this back seam. On packing units with a back seam, for example, several weakened zones can be placed in a line in the area of one of the two long sides on one or both side edges and in the area of the back seam.

BRIEF DESCRIPTION OF THE DRAWINGS

FIG. 1 shows diagrammatically the production and simultaneous filling of the product in a hose sachet with a folded back seam.

FIG. 2 shows a top view of an example of a packing unit of a laminate material according to the present invention and drawn below this a section through a packing along line A—A.

FIG. 3 shows the top view of a further example of a packing unit of a laminate material according to the present invention and drawn below this a section through the packing along line B—B.

FIG. 4 shows the top view of a further example of a packing unit of a laminate material according to the present invention and drawn below this a section through the packing along line C—C.

FIG. 5 shows a diagrammatic section through a variant of the laminate according to the present invention.

FIG. 6 shows a diagrammatic section through a further variant of the laminate according to the present invention.

FIG. 7 shows a diagrammatic section through a further variant of the laminate according to the present invention.

FIG. 8 shows a diagrammatic section through a further variant of the laminate according to the present invention.

FIG. 9 shows a front view of a packing unit of a laminate material according to FIG. 4 of the present invention.

FIG. 10 shows a view of one of the packing unit shown in FIG. 9.

FIG. 11 shows a view of the other side of the packing unit shown in FIG. 10.

DETAILED DESCRIPTION OF THE DRAWINGS

Figure 1:
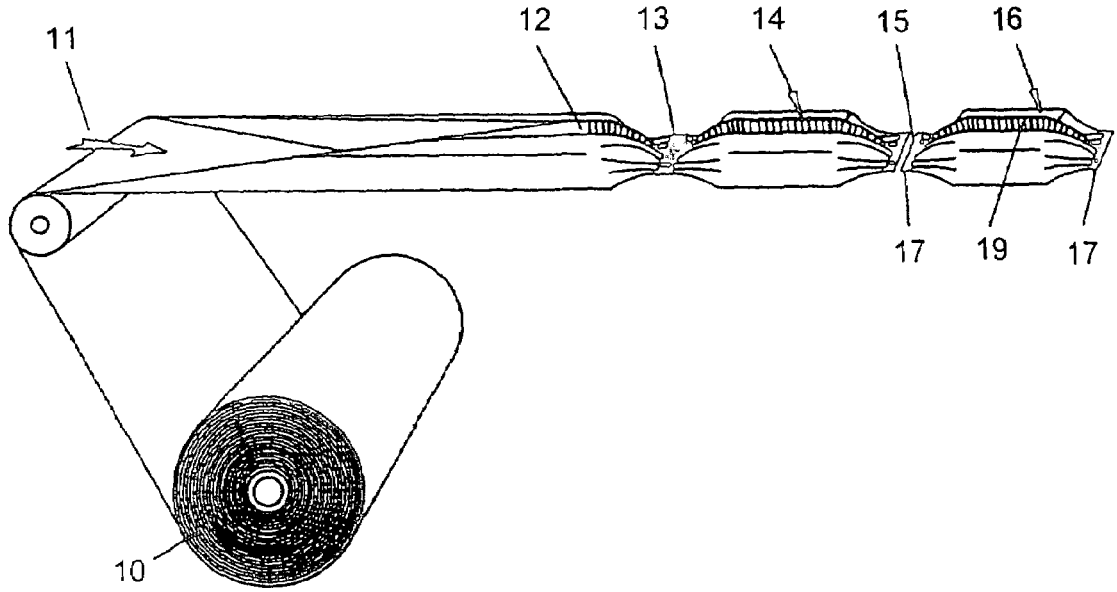
FIGS. 1 to 11 show, for example, various aspects of the present invention. In the drawings.

FIG. 1 shows a store of laminate material 10 in roll or endless form guided in the direction of arrow 11. Device parts of a packing machine which are not shown continuously fold and weld the folded longitudinal back seam 12 and the transverse seam 13. Also, in the direction of arrow 11 and at the point indicated by the arrow, the filling, for example chocolate bars, is inserted. The transverse seams 13 are laid in cycles, forming packing units 14. By means of cut 15 the packing units 16 are separated. The packing unit 16 has at both ends a transverse seam 17 and the folded longitudinal back seam 19.

Figure 2:
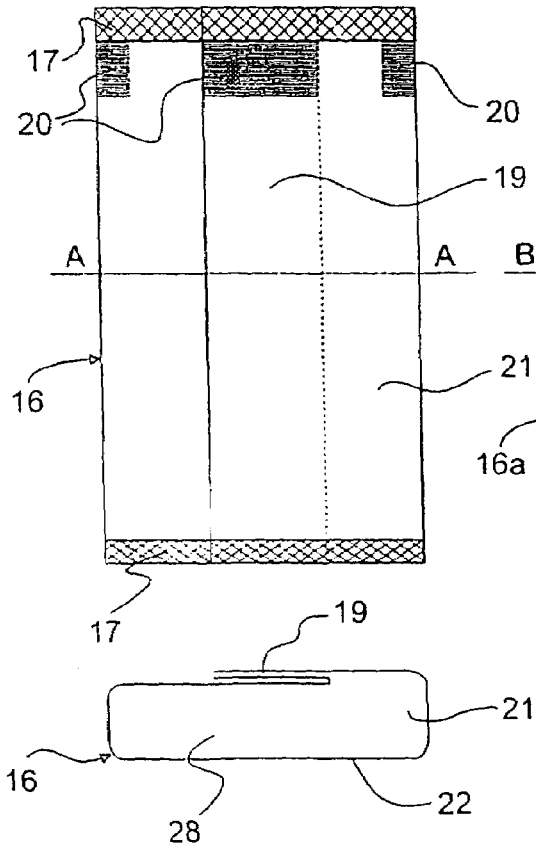

FIG. 2 shows a packing unit 16 with transverse seams 17 and longitudinal folded back seam 19. Parallel to a transverse seam 17 over the full width 21 are several weakened zones 20. A cross section through a packing unit 16 along line A—A shows the folded back seam 19. The weakened zones 20 lie at the side edges and at the point, here the back seam 19, at which the laminate material 22 lies in several material layers by folding and gluing. The laminate material surrounds the filling cavity 28.

Figure 3:
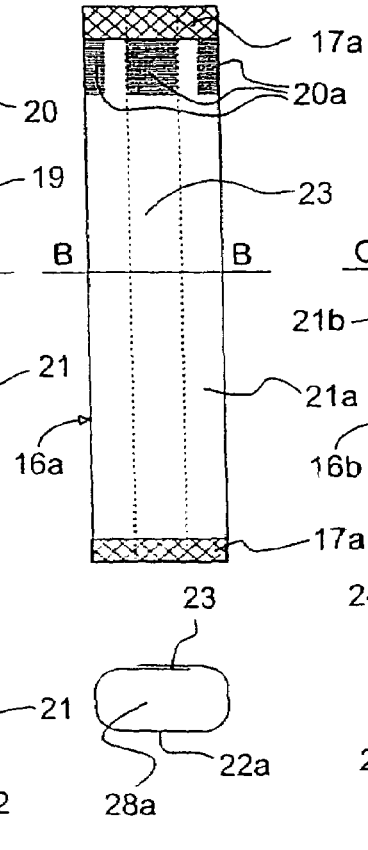

FIG. 3 shows a packing unit 16*a* with the transverse seams 17*a* and longitudinal overlapping back seam 23. Parallel to a transverse seam 17*a* over the filling area 21*a* are several weakened zones 20*a*. A cross section through a packing unit 16*a* along line B—B shows the overlapping back seam 19*a*. The weakened zones 20*a* lie at the side edges and at the point, here the overlapping back seam 23, at which the laminate material 22*a* lies in two material layers by gluing. The laminate material 22*a* surrounds the filling cavity 28*a*.

Figure 4:
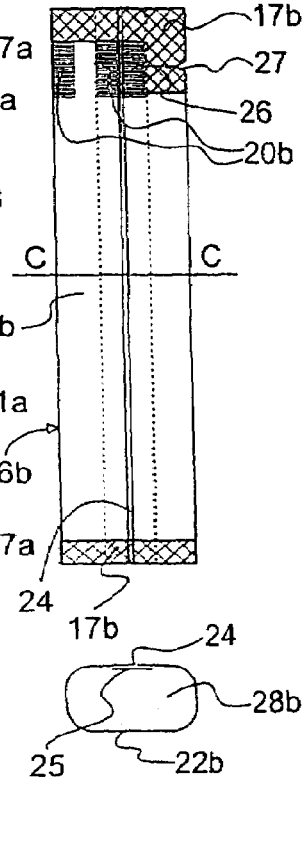

FIG. 4 shows the packing unit 16*b* with transverse seams 17*b*. The one transverse seam 17*b* extends unilaterally in the bag direction. In this extension of transverse seam 17 is a tear aid 27 and a perforation 26 which substantially extends through the entire thickness of the transverse seam 17*b*. The packing unit 16*b* is formed by a C-shaped alignment of the laminate material 22*b* and sealing of the edges on an inserted strip 25 of a sealable laminate, for example the structure polyethylene/adhesive/polyester/adhesive/polyethylene. By sealing the side edges of the laminate material at the strips 25, the longitudinal back seam 24 is formed. Parallel to a transverse seam 17*b*, substantially over the filling area 21*a*, are arranged two weakened zones 20*b*. For example the weakened zones can be a sequence of cuts, where the cut direction runs in the tear direction. In the present example the cut sequence constitutes the extension of the perforation 26. If the packing unit 16*b* is opened, the packing can be torn by way of the notch 27 in the sealed area of transverse seam 17*b*. The packing material is torn further by the perforation 26. The perforation 26 ends in the sealed area 17*b*. Due to the weakened zone 20 over the filling area, however, it is easy to tear along at least one cut of the cut sequence formed by the weakened zones 20. The cross section through a packing unit 16*b* along line C—C shows the longitudinal back seam 24. The weakened zones 20*b* lie on one of the side edges and at the point at which the laminate material 22*b* and the strips 25 lie above each other in two material layers. The laminate material 22*b* surrounds the filling cavity 28*b*.

Figure 5:
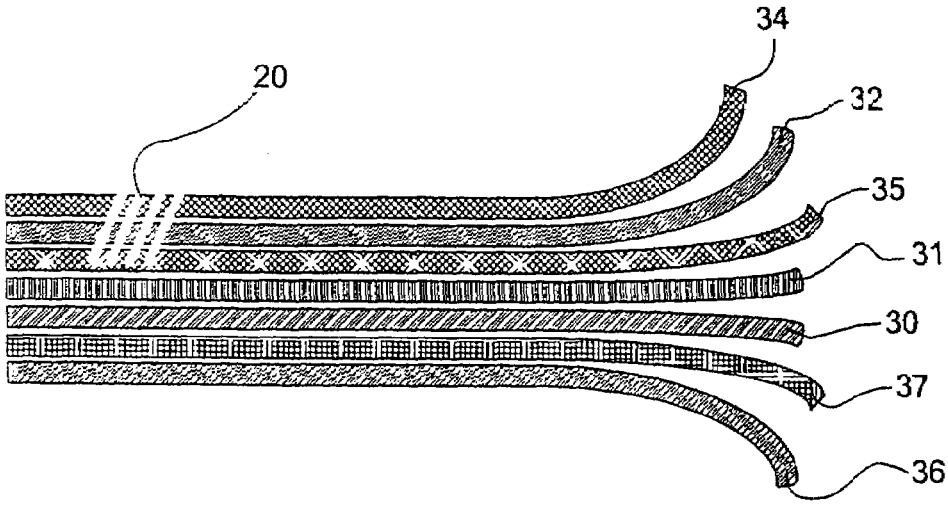

FIG. 5 shows the section through the structure of the film-like laminate material for the packing according to the invention, containing the first material layer of a film of thermoplastic 32 which carries a print 34 and a counter-print 35 and has a weakened zone 20. The second material layer of an aluminum foil 30, an adhesive coating 37 and a sealing coating 36 is connected to the first material layer by way of the adhesive coating or extrusion coating 31.

Figure 6:
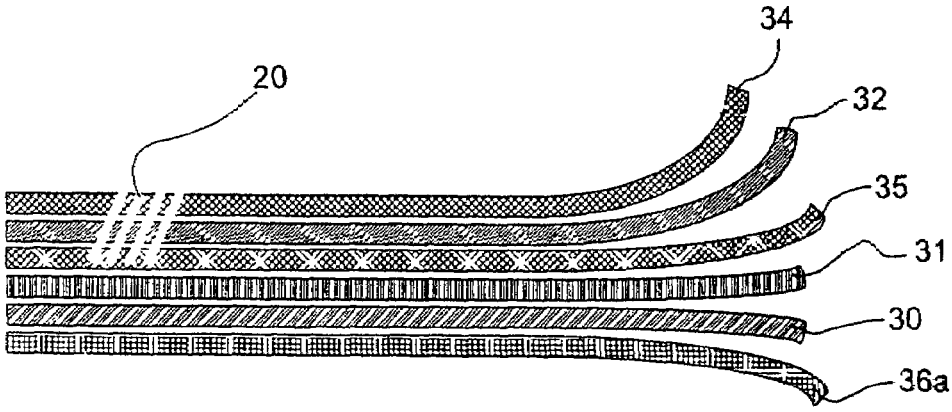

FIG. 6 shows a section through the structure of the film-like laminate material for the packing according to the invention, containing the first material layer of a film of thermoplastic 32 which carries a print 34 and a counter-print 35 and has a weakened zone 20. The second material layer of an aluminum foil 30, and extruded on this a sealing coating 36*a*, is connected to the first material layer by the adhesive coating or extrusion coating 31.

Figure 7:
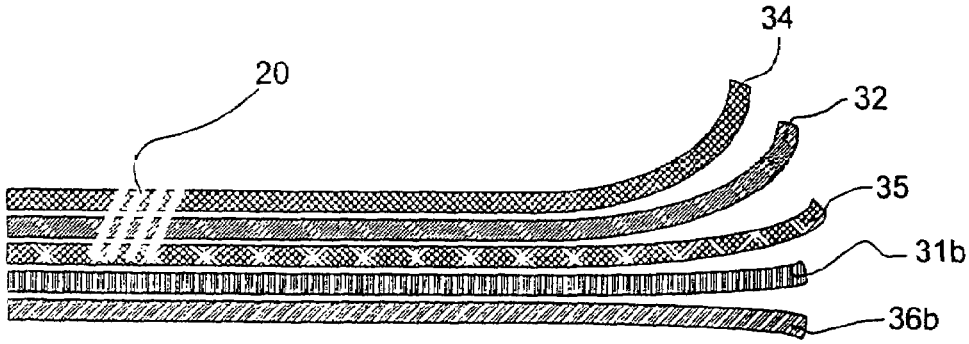

FIG. 7 shows a section through the structure of the film-like laminate material for the packing according to the invention, containing the first material layer of a film of thermoplastic 32 which carries a print 34 and a counter-print 35 and has a weakened zone 20. The second material layer of a sealing coating 36*b* is connected to the first material layer by way of the adhesive coating 31*b*.

Figure 8:
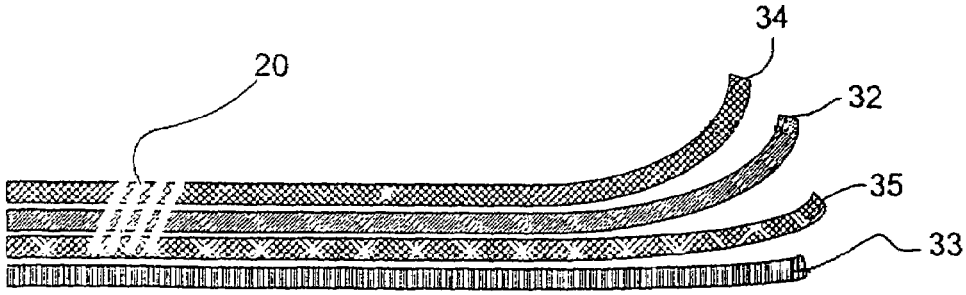

FIG. 8 shows a section through the structure of the film-like laminate material for the packing according to the invention, containing the first material layer of a film of thermoplastic 32 which carries a print 34 and a counter-print 35 and has a weakened zone 20. The second material layer is a coating 33 extruded onto the first material layer and made of a thermoplastic with sealing properties.

The present packings are suitable for example for holding liquid, powdery, granulate, solid or paste fillings. Liquid fillings range from drinks, juices etc. to cleaners or similar. Typical examples of fillings are powdery and granular foodstuffs and luxuries such as instant soup, instant coffee, coffee powder, custard powder, herbs etc. Solid fillings e.g. can take the form of blocks, slabs or bars. Examples are chocolate bars and muesli bars. In addition, the packing is suitable for paste-like foodstuffs such as yoghurt and other dairy produce, and other paste substances, for example from the area of personal hygiene and cosmetics such as shampoos or lotions, or to hold lipsticks, cotton buds, soaps etc. Finally, the packing according to the invention can also hold medical devices or applicators and technical articles.

Figure 9:
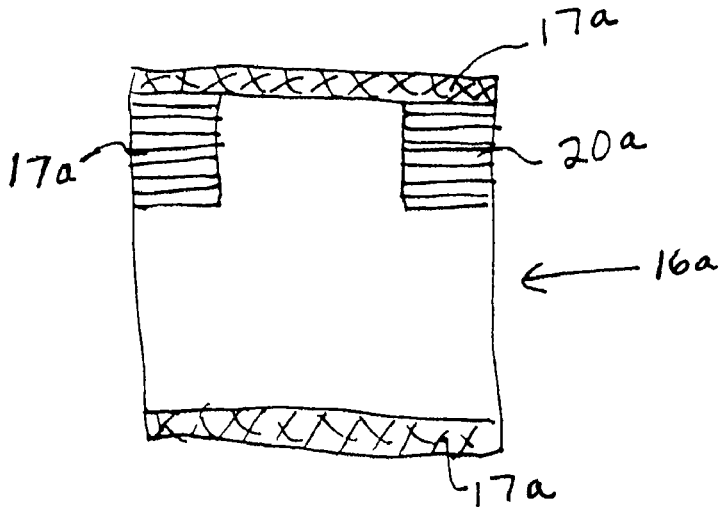
Figure 10:
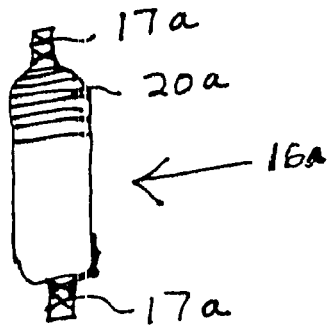
Figure 11:
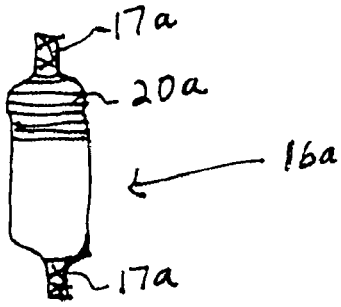

FIG. 9 shows the front of the packaging unit 16*a* of the embodiment shown in FIG. 4. Paralell to the top tranverse seam 17*a* and in the border area of one side thereof, lies a portion of a weakened zone 20*a*. Each such portion of a side weakened zone 20*a* is part of such weakened zone 20*a* that opens a side of packaging unit 16*a*. Each such weakened zone 20*a* is located across one of the sides edges of packaging unit 16*a* and extends onto the border areas of the front and back of the packaging unit 16*a*. FIGS. 10 and 11 each show one of the sides (edges) of the packaging unit of FIG. 3. In each of FIGS. 10 and 11, the portion of the weakened zone 20*b* shown is parallel to the top transverse seam 17*a*.

The invention claimed is:

1. A packaging (16*a*), made from a multilayer film laminate material, with a first side, a second side, two longitudinal edges, a first and a second transverse sealed edge (17*a*), a longitudinal back seam (23), formed by overlapping two longitudinal edges of the laminate material, on the second side, and an internal filing cavity (21*a*), there are three weakened zones (20*a*) with a tear direction as a tear aid, two of the weakened zones (20*a*) are each located on and near one of the longitudinal edges of packaging (16*a*), near the first transverse sealed edge (17*a*) and extending onto the second side and the first side, there being substantial distance between any two adjacent weakened zones (20*a*), third weakened zone (20*a*) is located on and extends transversely entirely across the longitudinal overlapped back seam (23) and near the first transverse sealed edge (17*a*), each weakened zone (20*a*) has a multiplicity of parallel rows of individual uninterrupted line cuts that run in the tear direction and that extend entirely across such weakened zone (20*a*), the weakened zones (20*a*) can each be located in same or different material of the laminate material, and at least part of each of the weakened zones (20*a*) lies in the area of the internal filling cavity (21*b*).

2. The packing according to claim 1, the weakened zones, on the packing that lie in a line and each has a width of 5 to 20 mm over the filing cavity.

3. The packing according to claim 1, wherein the weakened zones, on the packing that lie in (i) the area of each edge border, and (ii) in the area of the back side laminate material forming the back seam each has four lines of cuts.

4. The packing according to claim 1, wherein each of two of the weakened zones are arranged in an area of a transverse edge border or sealed edge border and parallel to this transverse edge border or sealed edge border and extend through outer layer of the laminate.

5. The packing according to claim 1, wherein each of the weakened zones are cut sequences or a multiplicity of individual cuts arranged in parallel, with a space between the individual cuts of 0.1 to 1 mm.

6. A laminate material for production of the packing according to claim 1, wherein at least one material of the laminate material has no weakened zones and at least one material layer of the laminate material has weakened zones.

7. A combination of the packing (16*a*) according to claim 1 with liquid, pasty, powdery, granulated or solid filling in internal cavity (21*a*) of the packing (16*a*).

* * * * *